United States Patent [19]

Bednar et al.

[11] 4,373,582

[45] Feb. 15, 1983

[54] ACOUSTICALLY CONTROLLED ELECTRO-MECHANICAL CIRCULATION SUB

[75] Inventors: John M. Bednar; Daniel P. Postler; Terry V. Jones, all of Houston, Tex.

[73] Assignee: Exxon Production Research Co., Houston, Tex.

[21] Appl. No.: 218,602

[22] Filed: Dec. 22, 1980

[51] Int. Cl.[3] ..... E21B 34/08; E21B 34/16

[52] U.S. Cl. ..... 166/65 R; 166/72; 166/321; 166/374

[58] Field of Search ..... 166/65 R, 319, 321, 166/332, 72, 188, 374, 375, 95, 364; 175/320, 321

[56] References Cited

U.S. PATENT DOCUMENTS

| | | | |
|---|---|---|---|
| 3,233,674 | 2/1966 | Leutwyler | 166/63 |
| 3,375,874 | 4/1968 | Cherry et al. | 166/321 X |
| 3,572,434 | 3/1971 | Ecuer | 166/319 X |
| 3,661,205 | 5/1972 | Belorgey | 166/65 R |
| 3,664,415 | 5/1972 | Wray et al. | 166/336 |
| 3,850,250 | 11/1974 | Holden et al. | 166/374 |
| 3,941,190 | 3/1976 | Conover | 166/187 |
| 3,961,308 | 6/1976 | Parker | 166/72 X |
| 4,073,341 | 2/1978 | Parker | 166/72 X |
| 4,129,184 | 12/1978 | Parker | 166/72 X |
| 4,147,222 | 4/1979 | Patten et al. | 166/364 |

*Primary Examiner*—Stephen J. Novosad
*Attorney, Agent, or Firm*—E. T. Wheelock

[57] ABSTRACT

This invention relates to a self-contained circulation sub which may be operated upon control from the surface. It may be in the shape of a short section of drill collar and utilizes a sleeve valve to cover the circulation ports. Upon reception of an acoustic signal from the surface, a control valve directs fluid from the pipe bore onto a pressure face on the sleeve valve. The sleeve valve then moves down and exposes the circulation ports thereby allowing drilling fluids to pass from its interior to its exterior.

53 Claims, 11 Drawing Figures

ACOUSTICALLY CONTROLLED ELECTRO-MECHANICAL CIRCULATION SUB

BACKGROUND OF THE INVENTION

This invention relates to an improved self-contained circulation sub used for passing drilling fluids from the interior of a drill string to its outside upon command from the surface. It particularly relates to an acoustically actuated electro-mechanical circulation sub.

Rotary drilling equipment used in the creation of oil and gas wells typically entails a long drill string which extends down into the borehole and is turned from the surface by a rotary table. The drill string itself is, simply stated, merely a series of detachable hollow pipe sections, nominally each of 30-foot length, terminated at the lower end by a drill bit. The drill string, which may be many thousands of feet long, is kept in tension to prevent its kinking. The drill bit must have some amount of downward force upon it or removal of downhole material fails to take place. The bit is weighted by drill collars which, in essence, are heavy, thick-walled sections of drill pipe. The drill collars are placed in the lower end of the drill string just above the drill bit.

Drilling through various strata of rock creates significant amounts of heat and drilling cuttings. Heat and cuttings typically are removed by drilling fluids or "muds" introduced into the drill string. The mud enters the hollow drill string at the surface, proceeds down through the drill pipe and drill collar sections, and exits the drill string through nozzles in the bit provided for that purpose. The mud cools the bit and carries the cuttings to the surface through the annular space formed by the borehole wall and the drill string.

Drilling mud performs a number of other functions during its circuit through the well. For instance, it controls subsurface pressures. Drilling a well of any significant depth requires the bit to traverse rock and sand strata of widely varying composition. Because of the variety of formation fluids contained in these strata, the pressure associated with them will vary widely. For instance, certain depleted Gulf Coast gas sands have localized pressures so low and porosities so great that a portion of the circulating mud disappears into the layers rather than returning to the surface. When this phenomenon reaches a critical point, a complete loss of mud circulation may occur. Clays, such as bentonite, can be added to the drilling mud to remedy the situation. Bentonite forms a thin, relatively impenetrable filter cake on the borehole wall in the region of the sand stratum. Proper addition of the bentonite to the mud will allow circulation of the mud to the surface to resume.

Another significant pressure problem occurs when a stratum bearing a high pressure fluid is penetrated. The localized downhole pressure may then exceed the liquid or hydraulic head of the drilling mud. If such occurs, a "kick" is observed and may result in a "blowout" of the drilling mud through the annulus at the surface. Muds having higher densities may be substituted for those already in the well. A higher density mud produces a correspondingly higher hydraulic head and can therefore keep the formation fluid in its stratum. However, until the higher density mud can be effectively introduced into the annular borehole space in the region of the offending stratum, the high pressure formation fluid entering the well must somehow be controlled.

An apparatus that keeps the high-pressure fluid in the well is known as a blowout preventer or, simply, as a "BOP". A BOP typically is a device that seals off the annular space found between the drill pipe and either the borehole wall or the well casing. It may be installed at the surface or, occasionally, downhole. The surface BOP is simple to install and operate in that size, power requirements, and control mechanisms are not overwhelming constraints. The downhole BOPs are more difficult to design because they must fit down inside a somewhat small borehole and still be operable from the surface. However, by thoughtful design of the equipment ancillary to the downhole BOP, an overall system having fast response to a "kick" and the versatility to easily circulate high density mud to the annulus above the high pressure stratum is possible.

A reliable downhole BOP is an especially large step forward in this art. A surface BOP will allow large downhole pressures to build up through the influx of formation fluids. The safety and integrity of a well can be compromised if the excessive pressures are allowed to linger. The downhole BOP suffers no such affliction since it isolates the flowing formation fluid in a small region near the drill bit.

BOPs are discussed in Ser. No. 219,631, filed Dec. 24, 1980, the entirety of which is incorporated by reference.

After a downhole BOP has been activated, the annular space and the pipe bore are closed to the circulation of mud. Since the only exit from pipe bore to annulus is by the nozzles in the now-isolated drill bit, some alternate route must be provided for circulating the drilling mud. A circulation sub provides that alternate route. It normally is placed in the drill string just above the downhole BOP. It provides controllable openings, known as circulation ports, so that drilling fluids can be passed from the inside of the drill string to the annulus.

Circulation subs in drill strings typically have been mechanically operated. A representative of this class of circulation subs is found in U.S. Pat. No. 3,941,190, to Conover. The Conover device, disclosed in conjunction with a downhole packer suitable for use as a blowout preventer, uses a spring-closed sleeve valve which prevents circulation through the ports until the device is actuated. Actuation of the circulation sub requires the insertion of a metal plug known as a "go-devil" into the pipe bore. The go-devil falls to a seat in the vicinity of the sleeve valve and utilizes the localized pressure to slide the seated go-devil and sleeve valve down and away from the mouth of the circulation ports. In order to re-start drilling operations, the driller must fish the go-devil out of the drill string along with some associated packer machinery which plugs the pipe bore.

As mentioned above, the inventive device may be acoustically actuated. Acoustically operated downhole devices are known. For instance U.S. Pat. Nos. 3,961,308; 4,073,341; and 4,129,184, all to Parker, discuss the use of acoustic waves to actuate the disaster valves often found in the tubing of production wells to shut off the flow of hydrocarbon fluids.

Another disclosure of acoustic actuation of a downhole tool is found in U.S. Pat. No. 3,233,674, to Leutwyler. In this instance an acoustic downhole receiver is used to trigger an explosive gas generator. The gas is used to inflate a resilient packer. These apparatus are obviously single use devices, the downhole portion of which must be replaced prior to each firing.

The theoretical use of torsionally propagated acoustic waves in the drill string to provide downhole communication was suggested in a paper entitled "A New Approach to Drill-String Acoustic Telemetry" by Squire and Whitehouse. This paper, SPE 8340, was presented at the Fall 1979 conference of the Society of Petroleum Engineers of AIME.

Certain other devices which bear a passing resemblance to a circulation sub are known. These devices are used either in testing formations for the presence of hydrocarbons after well completion or as disaster valves in production wells. They resemble circulation subs to the extent that they are suitable for remotely opening or closing a port in a pipe wall during the time that pipe is in a well.

Examples of such devices include the formation fluid sampling tools found in U.S. Pat. No. 3,664,415, to Wray et al and 3,850,250, to Holder, et al. Both use surface pumps to artificially enhance a downhole pressure used to open or close a sleeve valve covering the sample ports.

It is apparent that the prior art does not disclose or suggest using the pressure of the pipe bore drilling fluid as the motive fluid to open circulation ports in a circulation sub. Similarly the prior art does not show an electrically actuated control valve to control the disposition and use of such fluids. The use of a splined or slotted shaft in a control valve is not disclosed, nor is the use of an electric motor to move such a control valve. The combination of these elements with an acoustic receiver is, to our knowledge, unique.

SUMMARY OF THE INVENTION

This invention relates to a downhole circulation sub having special application as a portion of a drill string. In its most desirable configuration, it allows substantially unrestricted flow through its central pipe bore. It is wholly self-contained, desirably battery-powered, and actuated by a coded acoustic signal from the surface. It need not have any electrical connections to the surface, nor does it require the insertion of any mechanical artifices in the wellbore fluid to activate it.

The circulation sub assembly is desirably made of several major functional portions. A piston sleeve, held in place by a regulator spring, covers the drilling fluid circulation ports during normal drilling. When passage of drilling fluids from the pipe bore to the wellbore annulus is required, an acoustic signal is sent down from the surface to the acoustic receiver. This receiver, with its associated motor control circuitry and motor drive mechanism, moves a control valve. The control valve allows the high pressure of the pipe bore to press against the piston sleeve in such a way that it moves into a position no longer blocking the circulation ports.

This device has utility in circumstances where no disclosed prior art device would be useful. For instance, other prior art circulation subs require the insertion of a steel ball or a go-devil to actuate the sub. In periods of high formation fluid outflow, the inserted balls and go-devils may not reach their intended destination. The acoustic signal used by the inventive device is reliable under such circumstances.

It should be noted that even if the kicking well is quiet enough to allow the insertion of a ball or go-devil, such implements may take upwards of five minutes to reach their intended downhole position. The acoustic transmission is much faster.

DESCRIPTION OF THE PREFERRED EMBODIMENT

Figure 1:
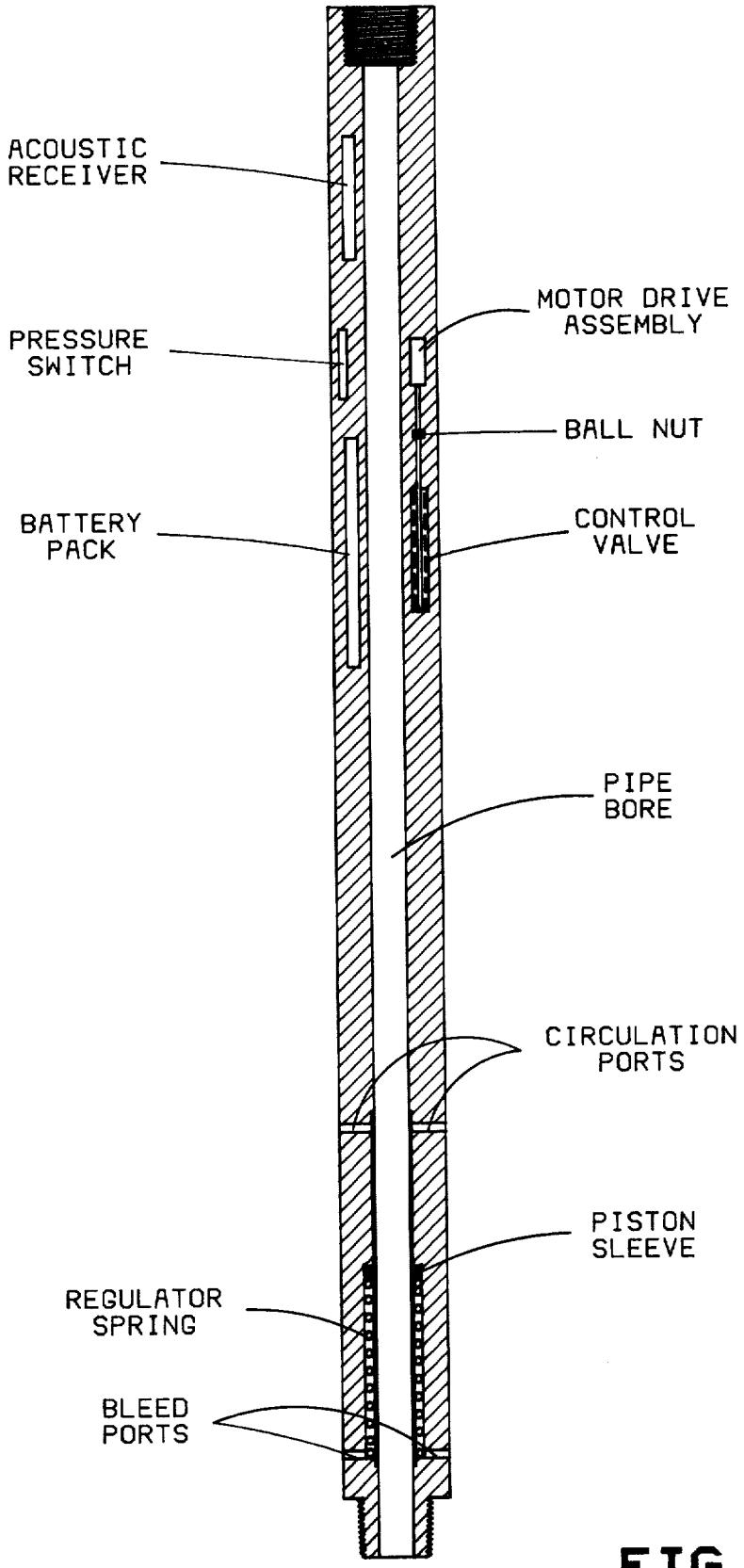
FIG. 1 depicts a generalized schematic cross-section of the preferred embodiment.

The most desirable configuration of the inventive circulation sub, as illustrated in FIG. 1, is that of a short section of drill collar. The sub can then be attached to adjacent sections of drill collar using the attached tool joints. The sub can be mounted anywhere in the drill string that increased circulation is desired. Typically, however, the sub will be placed in the lower section of the drill string just above a downhole BOP. The circulation sub has an unrestricted pipe bore extending the length of the apparatus allowing drilling fluids to pass from the upper end to the lower end.

The circulation sub operates by movement of a piston sleeve which combines the function of a piston, by which the sleeve is moved, and a sleeve valve, by which a port or set of ports is opened and closed. The local well pressures are utilized as the motive force for piston sleeve movement since the pipe bore pressure is almost always higher than the pressure in the wellbore annulus outside the circulation sub. The control valve directs either the pipe bore pressure or the exterior pressure against the piston face on the piston sleeve. The piston sleeve moves against the lower pressure outside the sub. Consequently, when the exterior pressure is directed against the piston face, the piston sleeve is pressure balanced, does not move, and the circulation ports remain covered. When the higher pipe bore pressure is directed against the piston face, the piston sleeve, seen in the lower end of FIG. 1, slides down against a regulator spring and uncovers the circulation ports. Drilling fluids are thus able to pass from the pipe bore to the sub's exterior.

The control valve, seen in the middle of FIG. 1, is set in motion by a motor drive assembly which, in turn, is actuated by the acoustic receiver receiving signals from an acoustic transmitter found at the surface of the well. The main function of the control valve is to maintain an open passageway between either the pipe bore and the piston sleeve or the sub exterior and the piston sleeve. If the differential pressure between pipe bore and the exterior is insufficient to overcome the force supplied by the regulator spring against the piston sleeve, then the sleeve will not move and the circulation ports will remain covered.

The most desirable method of actuating the motor drive assembly and control valve is by an acoustic receiver as is shown in the upper end of FIG. 1. A transmitter especially suitable for sending the needed acoustic waves is described in U.S. patent application Ser. No. 113,831, to Petersen et al, filed Jan. 21, 1980, and now U.S. Pat. No. 4,314,365. The choice of a particular acoustic receiver similarly is not critical. An acceptable design may be found in U.S. Pat. No. 3,961,308, to Parker, discussed above.

FIG. 1 also depicts the location of the battery pack which powers both acoustic receiver and the motor drive assembly. There is no need for any electrical connections to the surface. A pressure switch is located between the acoustic receiver and the battery pack and turns off all power when the pressure in the locale of the switch nears atmospheric.

Figure 2:
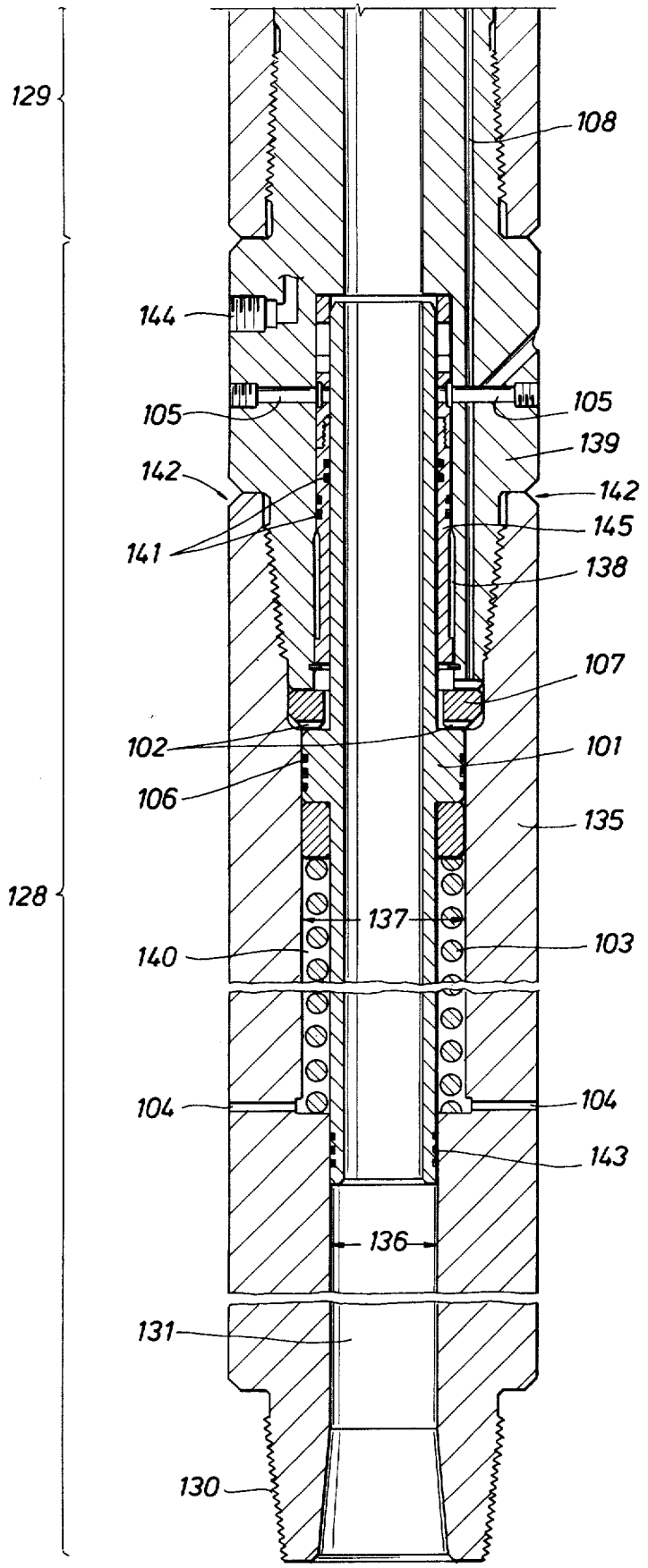
FIGS. 2–4 show a detailed cross-section of the preferred embodiment.
Figure 3:
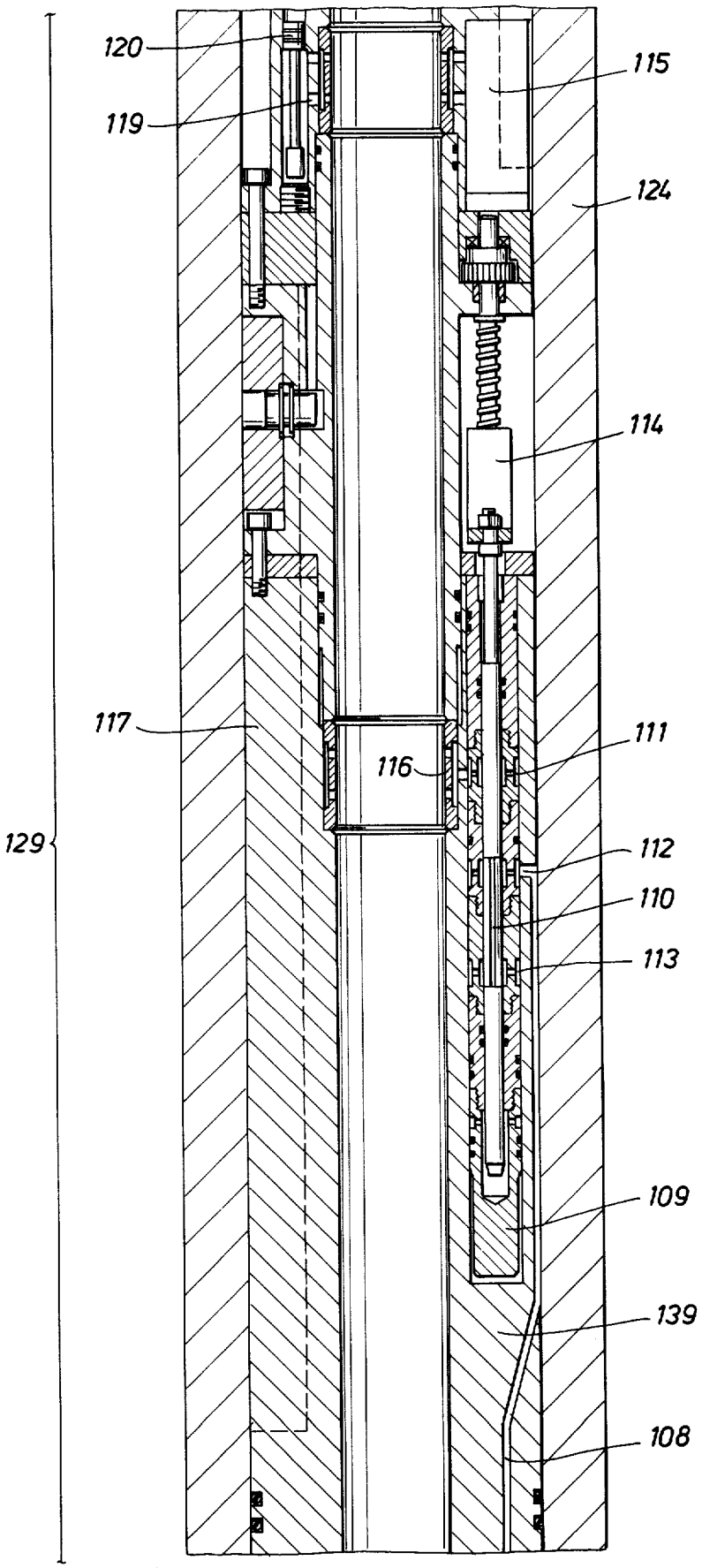
Figure 4:
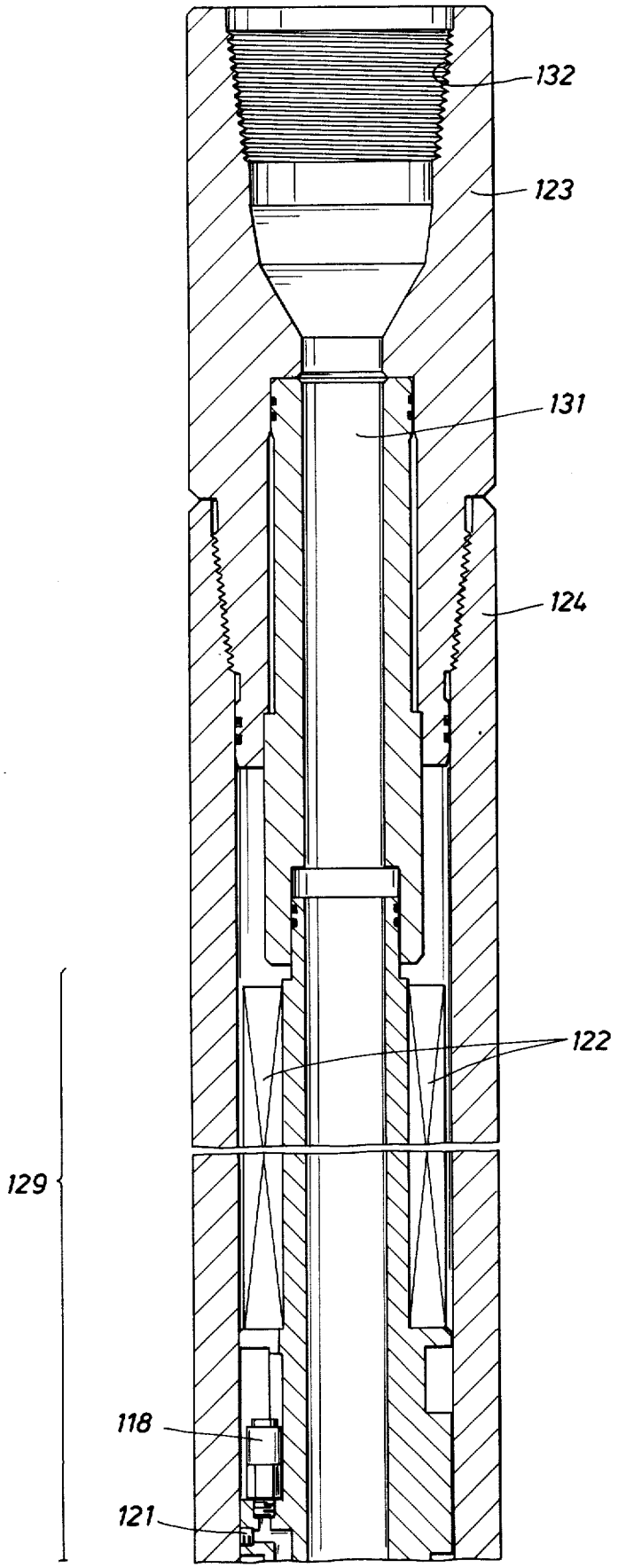

FIGS. 2–4, when placed end-to-end, depict the preferred embodiment of the inventive circulation sub.

The inventive circulation sub can be divided into two functional portions: a circulating section 128 which handles all drilling fluid flow from the inside to the outside of the sub, and a control section 129 which contains all of the necessary apparatus for controlling the circulation function. The circulating section 128 includes the lower sub 135, piston sleeve 101 and the lower end of control sub 139, which contains the throughflow circulating ports 105. The control section 129 includes the upper portion of control sub 139, which in turn supports the acoustic receiver 122, the control valve assembly 109 and 110, and the motor drive mechanism for actuating the control valve. The control section 129 is protected from drilling fluids and direct mechanical impact by outer structural shell 124. Top sub 123 structurally completes the upper end of the circulation sub. The lower sub 135, control sub 139, structural shell 124, and top sub 123, together form a housing which is able to withstand all of the mechanical stresses placed on it during drilling operations. These subs may be further subdivided for ease of assembly and maintenance, e.g., subdivided at 142. But for the purposes of describing the invention, such detailed rendering is not undertaken.

The lower sub 135 desirably is a machined product disposed about the piston sleeve 101 and regulator spring 103 and having passageways 108 running ultimately from the central control valve port 112 to adjacent the pressure face 102 of the piston sleeve 101. The control sub 139 has the necessary circulation ports 105 for passing drilling fluids from the pipe bore 131 to the exterior. A similar, but normally much smaller, set of bleed ports 104 allows communication of the chamber 140 in which the regulator spring 103 resides and the exterior of the circulating sub assembly. The lower sub 135 has, as its lower end, a threaded portion 130 suitable for attachment to a section of drill pipe or drill collar.

Figure 5:
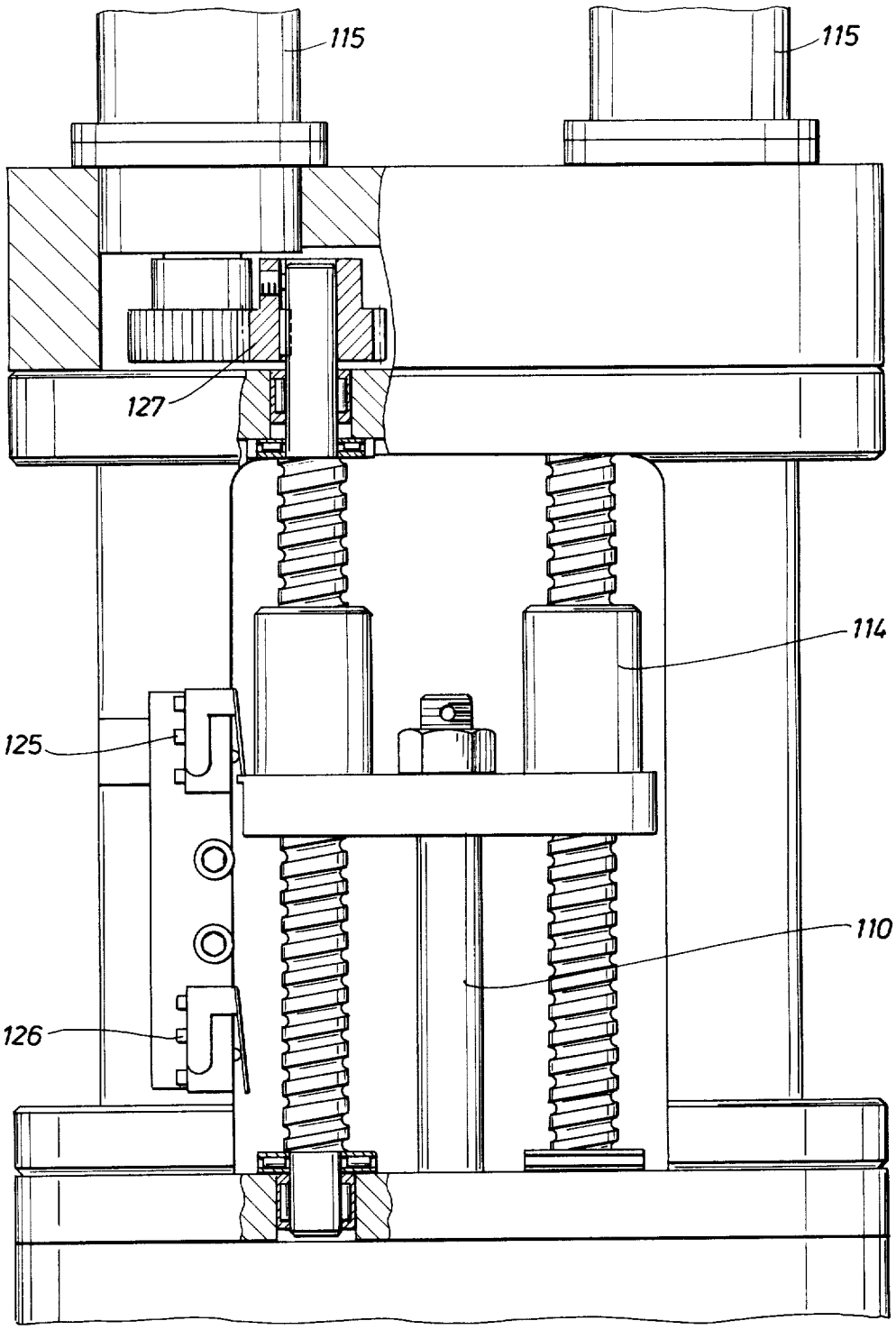
FIG. 5 shows an elevation of the motor drive assembly used to actuate the control valve assembly.

It should be apparent that assembly of the embodiment displayed in FIGS. 2–4 may entail some fabrication of sub-assemblies. For instance, the pressure switch 118, acoustic receiver 122, and drive motors 115 (all of which will be discussed in detail below) are pre-assembled in a motor housing subassembly. The motor drive assembly shown in FIG. 5 is pre-assembled and combined with the motor housing subassembly and attached to the upper end of control sub 139. Battery packs 117 and control valve body 109 are similarly installed in their receptacles in control sub 139. The outer structural shell 124 slips over the outside of the assembled stack and forms a sheath protecting that apparatus from the surrounding drilling fluid. Top sub 123 completes the upper end of the tool. It is equipped with a threaded female tool joint 132 which will fit the next upper drill pipe or drill collar section in the drill string. The top sub 123, outer structural shell 124, control sub 139, and lower sub 135 bear all of the stresses to which the inventive circulating sub is subjected during drilling.

With this overall description of the circulating sub assembly as background, the specifics of design and operation are described.

The basic function of the circulation sub is to pass a fluid from the interior of the device to its exterior when called upon to do so. The circulation ports 105 allow such fluid passage when the piston sleeve 101 is moved from the mouths of those ports.

The piston sleeve 101 is desirably an open-ended hollow cylinder having a relatively constant inside diameter and a relatively constant outside diameter except in its mid-section where a cylinder or shoulder having two piston faces is concentrically machined about the axis of the sleeve. The lower face of the shoulder contacts the regulator spring 103; the upper face 102 of the shoulder forms the piston's pressure face. The outer edge of the piston is supported by and movably slides in a bore 137 provided in lower sub 135. The pressure face 102 is desirably perpendicular to the sliding motion of the piston sleeve 101 for optimum efficiency in the use of the pipe bore pressure.

It is against pressure face 102 that the control valve directs the pipe bore pressure. The opposite face of the shoulder, as mentioned above, fits against a regulator spring 103 which is within a chamber 140 formed by the outside diameter of the piston sleeve 101 and the inside bore 137 of lower sub 135. The pressure in chamber 140 is the same as the pressure exterior to the circulation sub due to open bleed ports 104.

It is desirable to additionally support the piston sleeve 101 by matching the outside diameter of the piston sleeve to one or more bores inside the lower sub 135 or inside a seal carrier 145 housed in the lower end of control sub 139 in bore 138. Obviously, to prevent binding of the piston sleeve 101 during movement, bores 136, 137 and 138 should be concentric with regard to each other and have the same central axis.

To ensure optimum operation of the piston sleeve 101, it is advantageous to isolate the region on the sleeve having adjacent high and low pressures during operation. Pressure face 102 is thus maintained at its operational pressure by seals 141 and 106. It may be desirable to include metal-to-metal shoulder seals at sub junctions such as that found in FIG. 2 at 142. These shoulder seals are machined as part of the threaded connections joining the individual subs. A shoulder seal at 142 isolates the small chamber above pressure face 102 from the pressure of the wellbore annulus. Leakage of high pressure pipe bore fluid into regulator spring chamber 140 is prevented by seals 106 and 143. Resilient seals such as "O" rings may be adequate to isolate various pressure regions where the pressure differential between the pipe bore and the sub exterior is low. However, resilient "T" seals having radial supports extending radially in the grooves supporting seals 106, 141 and 143 are most preferable. Metallic piston rings may also be used, if so desired. A bumper ring 107 may be included between control sub 139 and the pressure face 102 of the piston sleeve 101 to protect the tip of the threaded male connection at the lower extremity of control sub 139 from damage as the piston sleeve 101 returns to the up or closed positions.

The piston sleeve 101, during normal drilling operations, is held in a position covering circulation ports 105 by the regulator spring 103. See the position of sleeve valve 101 in FIG. 7A. When the control valve assembly allows fluid communication between the pipe bore 131 and the pressure face 102 through passageways 108, the piston sleeve is then capable of moving. Although only one passageway 108 is depicted, it is contemplated that a number of such passageways will be used. If the pipe bore pressure is sufficient to overcome the combined pressure of the regulator spring 103 and the well annulus pressure found in chamber 140, the piston sleeve 101 will move downward displacing fluid through bleed ports 104. When piston sleeve 101 is fully lowered, as is depicted in FIG. 7B, circulation ports 105 will then be uncovered. Drilling fluid may then pass from the interior pipe bore 131 to the wellbore annulus exterior to the sub.

It is theoretically possible that the act of opening the circulation ports will drop the pipe bore pressure to such a level that the piston sleeve will begin to close the circulation ports 105. Closure of the ports will again tend to raise the pipe bore pressure which in turn opens the piston sleeve. Such oscillations are not normally expected since the drive pressure required to fully lower piston sleeve 101 is chosen to be quite low. If oscillation is recurring, the regulator spring rate can be changed.

When the control valve assembly is returned to its original position, the high pressure fluid formerly acting against pressure face 102 will bleed off into the annulus and thereby balance the fluid pressure against pressure face 102 with that in chamber 140. The regulator spring will then return the piston sleeve 101 to its original position.

The control valve assembly, as noted above, has the function of placing the pressure face 102 of the piston sleeve 101 in fluid communication either with the fluid outside the circulation sub assembly or with the higher pressure fluid in the pipe bore 131.

Figure 6A:
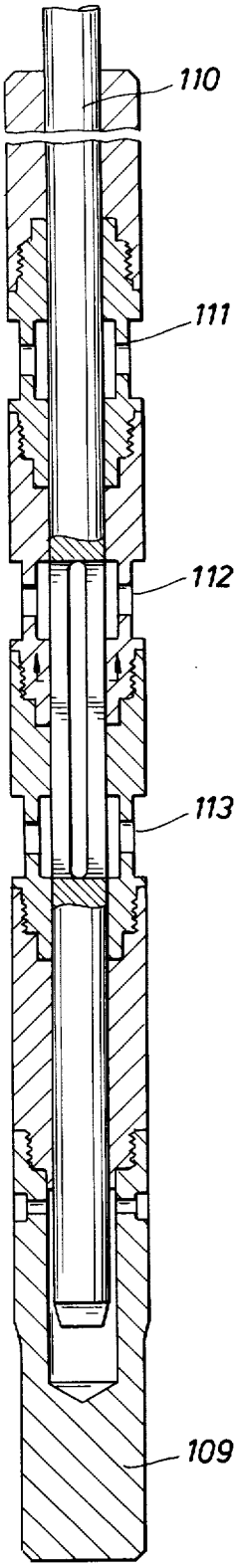
FIG. 6A provides a side view cross-section of the control valve assembly.

One very desirable configuration for the control valve assembly utilizes a sleeve-shaped control valve body 109 having three sets of ports, each of which extend from the interior of the sleeve to its outside (See FIG. 6A). These ports are spaced along the axis of the valve body. The exterior of the upper port 111 is open to the pipe bore 131 through aperture 116. The middle port 112 is in fluid communication to pressure face 102 on piston sleeve 101 through passageways 108. The lowest valve port 113 opens to the exterior of the circulation sub. Circumferential recesses are desirably placed on the inside of the valve body in the region around each of the ports so as to allow ease of access by the fluid.

Figure 6B:
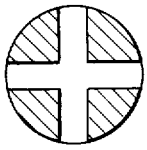
FIGS. 6B and 6C provide two top view cross-sections of a slotted valve stem.
Figure 6C:
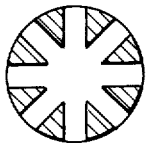

The valve stem 110, in this configuration, is essentially a rod which fits closely inside the valve body 109. The stem allows fluid flow between two adjacent valve body ports through cavities placed in the valve stem. The cavities may take the form of a neck produced by machining material from the valve stem. The stem may be cross-drilled at a slant to form a flow path. The most desirable configuration from the viewpoint of strength and fluid flow entails the incorporation of a number of slots or grooves along the axis of the valve stem. FIGS. 6B and C illustrate, in cross-section, two desirable configurations of a slotted valve stem. Regardless of which valve stem cavity is chosen, it results in a flow path having a length extending only from the middle control port 112 to one of the other valve body ports. The valve stem 110 is placed so that in one position, it allows a fluid communication between the middle port 112 and the upper valve body port 111 while shutting lower port 113. In its other position, the valve stem 110 allows fluid communication between the middle port 112 and the lower valve body port 113 while closing upper valve body port 111.

Other control valve assembly configurations are suitable for use in this invention. For instance, the stem may remain stationary and the valve body move. Rotary valves are also acceptable.

The drive motor assembly as illustrated in FIG. 5 optimally has redundant drive motors 115 driving a ball nut assembly 114 through a gear set 127. Limit switches 125 and 126 can be placed at each end of the ball nut travel. The limit switches provide assurance that the control valve stem 110 moves only as far, in either direction, as is necessary to provide fluid communication between the middle control port 112 and either of the two remaining valve body ports 111 or 113. It should be apparent that other methods of limiting control valve stem 110 movement would be known to one having ordinary skill in this art. For instance, an electronic timing clock can be utilized to limit such movement. The drive motors need not have a large horsepower rating since the control valve assembly is not called upon to cut off a flowing stream. It is nevertheless necessary to size the drive motors 115, as shown in FIG. 5, so that the motors' total horsepower is capable of moving the control valve stem 110 through its stroke. The motor drive assembly need not be as elaborate as illustrated in FIG. 5, with dual motors 115, gear box 127, and ball nut assembly 114. The drive may comprise other layouts such as a single motor direct drive or, in some circumstances, a solenoid to move the valve stem 110. Each different layout has its benefits and detriments although from a reliability viewpoint the illustrated motor drive assembly is highly regarded.

It is also contemplated that the valve stem 110 be moved using hydraulic actuators. For instance, electric motors can be used to drive hydraulic pumps and power such actuators.

The battery packs 117, shown in FIG. 3, may be of any type acceptable to do the job in the wellbore environment. Nickel-cadmium, or "NICAD", batteries are suitable and can be commercially obtained in many forms and sizes. It should be noted that most battery systems have a decline in voltage output with an increase in temperature. In drilling a well that is especially deep and therefore hot, choice of a battery type can be critical. The rated voltage of the battery pack must be sufficient at the downhole temperature to meet the operational voltage of the drive motors. Inclusion of the battery pack in a protective sleeve may be desirable.

It is desirable to add an external socket 144 (FIG. 2) with connective leads to the battery pack 117 to allow recharging while the circulation sub assembly is on the surface. This negates the need for disassembly of the sub for battery charging.

Another illustrated feature which is desirable and adds to the reliability of the circulating sub assembly is the pressure switch assembly. This assembly, as seen in FIGS. 3 and 4, comprises an electrical switch 118 which senses the localized pipe bore pressure through a port 119. If the pressure is near, e.g. below or within 100 psi of, atmospheric pressure, the pressure switch assembly cuts off all electrical power from the batteries to the electronics and the drive motors 115. Thus, the pressure switch has the major function of preserving battery freshness when the circulating assembly is at or near the surface.

The pressure switch 118 is isolated from the drilling fluids found in port 119 by an isolation piston 120. This piston has drilling fluid on the port side and an inert incompressible fluid, such as an oil, in a displacement chamber 121, on its switch side. As the circulation sub assembly is lowered in a borehole and the hydrostatic head of the drilling fluid increases to the point that piston 120 begins to move, the fluid in the displacement chamber 121 actuates the pressure switch 118. A spring return on the pressure switch 118 provides an opposite motion when the pressure is lowered as the circulation sub assembly is run out of the hole.

As noted above, the acoustic receiver 122 and its associated electronics can be of a design such as that found in U.S. Pat. No. 3,961,308, noted above. We have found that encoding the surface-originated job command as a series of binary digits and utilizing the drill string as the acoustic conductor is an excellent method of relaying that command to the circulation sub assembly. Desirably the binary zero is a longitudinally or torsionally applied frequency shift keyed (FSK) signal of about 310±20 Hz or most preferably 316±4 Hz. The binary one is 370±20 Hz and most preferably of 374±3 Hz. Of course, the frequencies enumerated for the binary one and binary zero may be swapped one for the other with no change in utility. Higher frequencies tend to quickly attenuate as they traverse the drill pipe; lower frequencies are often in interference with naturally-occurring noises in the borehole. See U.S. Pat. No. 4,314,365, issued on Feb. 2, 1982. Use of the drilling fluid as a conductor for the acoustic signal is also contemplated.

Figure 7A:
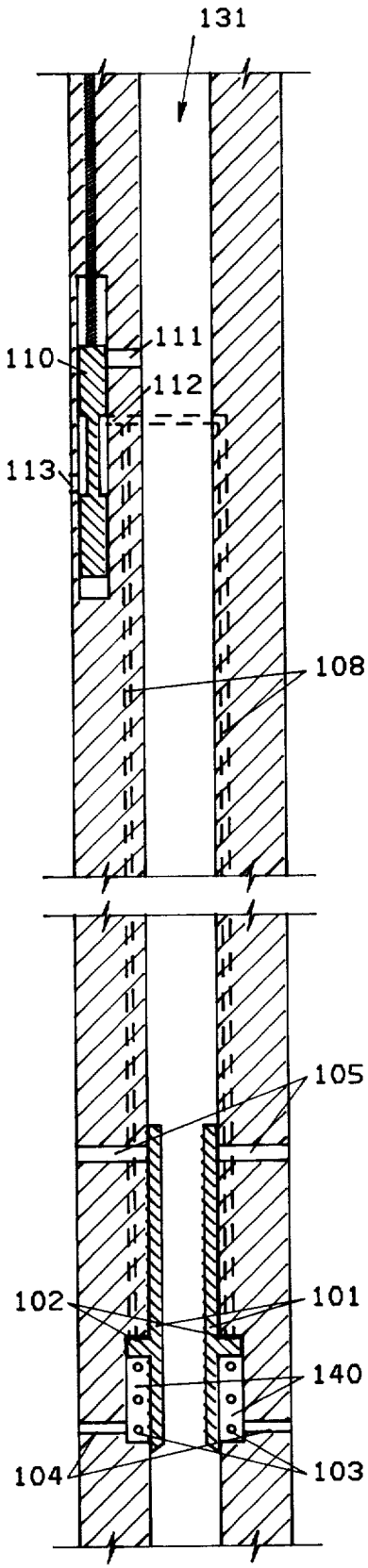
FIGS. 7A–7C illustrate the manner in which the circulation sub operates.
Figure 7B:
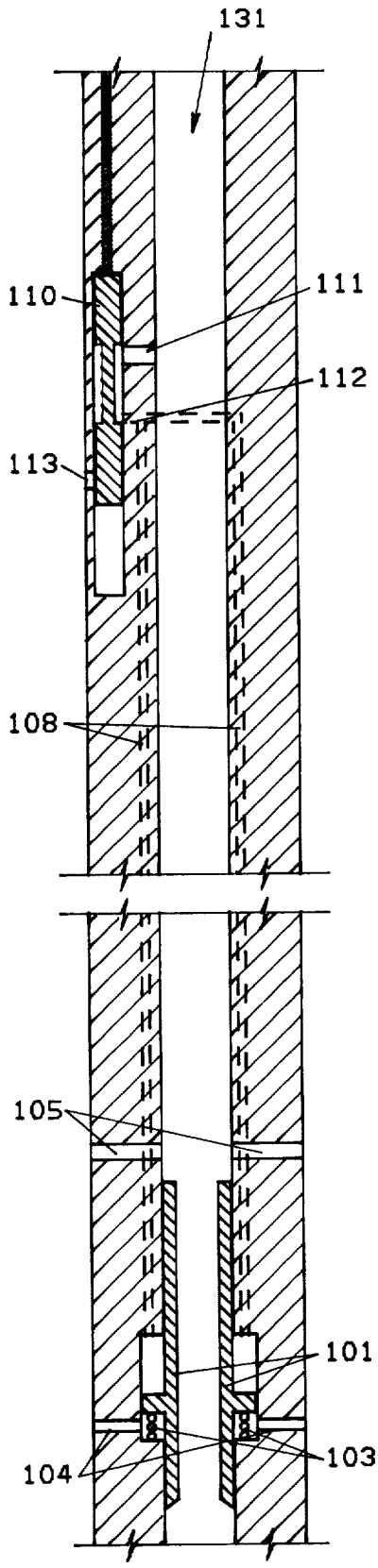
Figure 7C:
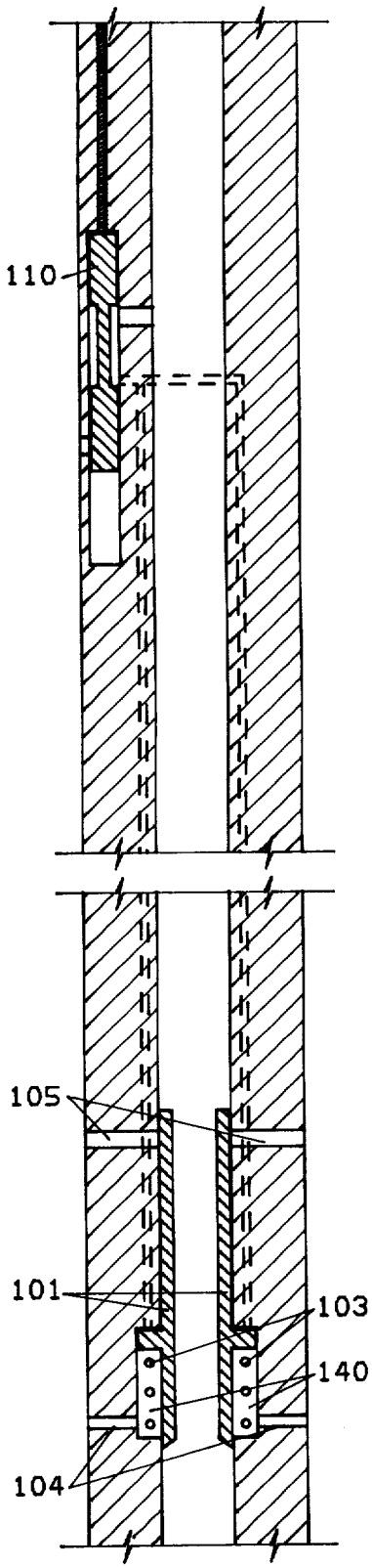

The operation of the circulation sub assembly is schematically illustrated (in cross section) in FIGS. 7A–7C. In FIG. 7A, the assembly is in normal drilling configuration. The control valve stem 110 is in the "down" position thereby closing off the upper valve port 111 to the pipe bore 131 but allowing fluid communication between lower control valve port 113 and the middle control valve port 112. The middle control valve port 112 is always in fluid communication with the pressure face 102 of the piston sleeve 101 via passageways 108. The regulator spring chamber 140 is at the same pressure as found at lower control valve port 113. Since the pressure at pressure face 102 is the same as that in regulator spring chamber 140, the regulator spring 103 maintains the piston sleeve 101 in position covering circulation ports 105.

In FIG. 7B, a command has been relayed from the surface and, accordingly, the control valve stem 110 has been moved to the "up" position thereby closing off lower control port 113 and allowing fluid communication between upper port 111 and middle port 112. In most circumstances, the borehole 131 pressure would be substantially higher than that found at bleed port 104. If the pressure found at upper valve port 111 is sufficient to overcome the pressure at bleed port 104 plus the force supplied by regulator spring 103, then piston sleeve 101 will move downward exposing circulation ports 105 and allowing fluid to pass into the annulus.

However, in the eventuality that the pressure in borehole 131 is insufficient to overcome the pressure outside the circulation sub assembly plus the force supplied by regulator spring 103, such as when the circulating pumps at the surface are stopped, the piston sleeve 101 will remain over the circulation ports 105, as seen in FIG. 7C.

The relative positions of the components of the inventive circulating sub can be varied within the scope of the invention. The drawings and description are only for the purpose of illustration. Placement of the control valve and acoustic receiver below the piston sleeve in the circulation sub is contemplated. Other changes in size, shape, materials of construction, configuration, as well as in the details of the illustrated construction may be made within the scope of the appended claims without departing from the spirit of the invention.

We claim:

1. A device for use in a well which may be used as a circulation sub comprising:

a housing having an inner bore, an exterior wall, and at least one circulation port allowing fluid communication between the inner bore and the exterior wall;

a piston sleeve slidably mounted within the inner bore of the housing, covering said at least one circulation port in one position, and having pressure responsive means adapted to slidably move the piston sleeve to another position uncovering said at least one circulation port upon application of sufficient fluid pressure;

a control valve assembly for applying fluid pressure to the pressure responsive means of the piston sleeve and having a sleeve-shaped valve body with a first opening through the wall of said valve body in open communication with the pressure responsive means of the piston sleeve, a second opening through the wall of said valve body in open communication with the inner bore of the housing, a third opening through the wall of said valve body in open communication with the exterior of the housing, and also having a valve stem slidingly fitted within the valve body and adapted to allow, in a first position, communication between the first and third valve body openings while covering the second and, in a second position, communication between the first and second valve body openings while covering the third so as to allow said piston sleeve to move to a piston uncovering said at least one circulation port; and means for slidably moving the valve stem relative to the valve body.

2. The apparatus of claim 1 wherein the housing is adapted at its upper and lower ends to connect to well drilling pipe or collars.

3. The apparatus of claim 1 wherein the piston sleeve is held in position covering said at least one circulation port by a regulator spring.

4. The apparatus of claim 1 wherein the valve stem is splined to allow fluid communication between said valve body openings.

5. The apparatus of claim 1 wherein the valve stem is necked down to allow fluid communication between said valve body openings.

6. The apparatus of claim 1 wherein the valve stem is slotted to allow fluid communication between said valve body openings.

7. The apparatus of claim 1 wherein the means for slidably moving the valve stem comprises at least one electric motor.

8. The apparatus of claim 7 wherein the means for slidably moving the valve stem additionally comprises a ball nut.

9. The apparatus of claim 7 or 8 wherein at least one limit switch limits the movement of the valve stem between said one position and said other position.

10. The apparatus of claim 7 additionally comprising battery means suitable for powering said at least one electric motor.

11. The apparatus of claim 10 additionally comprising a pressure switch adapted to electrically isolate said battery means when inner bore pressure nears atmospheric.

12. The apparatus of claim 10 additionally comprising means adapted to allow charging of said battery means.

13. The apparatus of claim 1 wherein the means for slidably moving the valve stem comprises a solenoid.

14. The apparatus of claim 1 wherein the means for slidably moving the valve stem comprises a hydraulic actuator.

15. A device suitable for use as a circulation sub in a well comprising:

a housing having an inner bore, an exterior wall, and at least one circulation port allowing fluid communication between the inner bore and the exterior wall;

a piston sleeve slidably mounted within the inner bore of the housing, covering said at least one circulation port in one position, and having pressure responsive means adapted to slidably move the piston sleeve to another position uncovering said at least one circulation port upon application of sufficient fluid pressure;

a control valve assembly for applying fluid pressure to the pressure responsive means of the piston sleeve and having a sleeve-shaped valve body with a first opening through the wall of said valve body in open communication with the pressure responsive means of the piston sleeve, a second opening through the wall of said valve body in open communication with the inner bore of the housing, a third opening through the wall of said valve body in open communication with the exterior of the housing, and also having a valve stem slidingly fitted within the valve body and adapted to allow, in a first position, communication between the first and third valve body openings while covering the second and, in a second position, communication between the first and second valve body openings while covering the third so as to allow said piston sleeve to move to a position uncovering said at least one circulation port;

means for slidably moving the valve stem relative to the valve body; and means for receiving an acoustic signal from the upper portion of the well adapted to actuate means for slidably moving the valve stem within the valve body.

16. The apparatus of claim 15 wherein the housing is adapted at its upper and lower ends to connect to well drilling pipe or collars.

17. The apparatus of claim 15 wherein the piston sleeve is held in position covering said at least one circulation port by a regulator spring.

18. The apparatus of claim 15 wherein the valve stem is splined to allow fluid communication between said valve body openings.

19. The apparatus of claim 15 wherein the valve stem is necked down to allow fluid communication between said valve body openings.

20. The apparatus of claim 15 wherein the valve stem is slotted to allow fluid communication between said valve body openings.

21. The apparatus of claim 15 wherein the means for slidably moving the valve stem comprises at least one electric motor.

22. The apparatus of claim 21 wherein the means for slidably moving the valve stem additionally comprises a ball nut.

23. The apparatus of claim 21 or 22 wherein at least one limit switch limits the movement of the valve stem between said first position and said second position.

24. The apparatus of claim 21 additionally comprising battery means suitable for powering said at least one electric motor.

25. The apparatus of claim 24 additionally comprising a pressure switch adapted to electrically isolate said battery means when inner bore pressure nears atmospheric.

26. The apparatus of claim 24 additionally comprising means adapted to allow charging of said battery means.

27. The apparatus of claim 15 wherein the means for slidably moving the valve stem comprises a solenoid.

28. The apparatus of claim 15 wherein the means for slidably moving the valve stem comprises a hydraulic actuator.

29. The apparatus of claim 15 wherein said means for receiving an acoustic signal is adapted to be responsive to FSK signals of 310±20 Hz and 370±20 Hz.

30. The apparatus of claim 29 wherein said means for receiving an acoustic signal is adapted to be responsive to FSK signals of 316±4 Hz and 374±3 Hz.

31. A device suitable for use as a circulation sub in a well comprising:

a housing having an inner bore, an exterior wall, and at least one circulation port allowing fluid communication between the inner bore and the exterior wall;

valve means adapted to close said at least one circulation port and having pressure responsive means adapted to be openable in response to application of sufficient pressure;

a control valve assembly for applying fluid pressure to the pressure responsive means of the valve means and having a sleeve-shaped control valve body with a first opening through the wall of said control valve body in open communication with the pressure responsive means of the valve means, a second opening through the wall of said control valve body in open communication with the inner bore of the housing, a third through the wall of said control valve body in open communication with the exterior of the housing, and also having a control valve stem slidingly fitted within the control valve body and adapted to allow, in a first position, communication between the first and third control valve body openings while covering the second and, in a second position, communication between the first and second control valve body openings while covering the third so as to allow said valve means to open;

means for slidably moving the control valve stem relative to the control valve body; and means for receiving an acoustic signal from an upper portion of the well adapted to actuate means for slidably moving the control valve stem within the control valve body.

32. The apparatus of claim 31 wherein the housing is adapted at its upper and lower ends to connect to well drilling pipe or collars.

33. The apparatus of claim 31 wherein the control valve stem is splined to allow fluid communication between said valve body openings.

34. The apparatus of claim 31 wherein the control valve stem is necked down to allow fluid communication between said control valve body openings.

35. The apparatus of claim 31 wherein the control valve stem is slotted to allow fluid communication between said control valve body openings.

36. The apparatus of claim 31 wherein the means for slidably moving the control valve stem comprises at least one electric motor.

37. The apparatus of claim 36 wherein the means for slidably moving the control valve stem additionally comprises a ball nut.

38. The apparatus of claim 36 or 37 wherein at least one limit switch limits the movement of the control valve stem between said first position and said second position.

39. The apparatus of claim 36 additionally comprising battery means suitable for powering said at least one electric motor.

40. The apparatus of claim 39 additionally comprising a pressure switch adapted to electrically isolate said battery means when inner bore pressure nears atmospheric.

41. The apparatus of claim 39 additionally comprising means adapted to allow charging of said battery means.

42. The apparatus of claim 31 wherein the means for slidably moving the control valve stem comprises a solenoid.

43. The apparatus of claim 31 wherein the means for slidably moving the control valve stem comprises a hydraulic actuator.

44. The apparatus of claim 31 wherein said means for receiving an acoustic signal is adapted to be responsive to FSK signals of 310±20 Hz and 370±20 Hz.

45. The apparatus of claim 44 wherein said means for receiving an acoustic signal is adapted to be responsive to FSK signals of 316±4 Hz and 374±3 Hz.

46. A device suitable for use in a wall as circulation sub comprising:

a housing having an inner bore, an exterior wall, at least one circulation port allowing fluid communication between the inner bore and the exterior wall and adapted at its upper and lower ends to connect to well drilling pipe or collars;

a piston sleeve slidably mounted within the inner bore of the housing, covering said at least one circulation port in one position, and having pressure responsive means adapted to move the piston sleeve to another position uncovering said at least one circulation port upon application of sufficient fluid pressure from the fluid communicating between the inner bore and exterior wall;

control valve means adapted to apply said sufficient fluid pressure to said piston sleeve pressure responsive means to move said piston sleeve to said another position; and means for receiving an acoustic signal from an upper portion of the well and adapted to actuate said control valve means.

47. The apparatus of claim 46 wherein the piston sleeve is held in position covering said at least one circulation port by a regulator spring.

48. The apparatus of claim 46 wherein said means adapted to actuate the control valve includes an electric motor.

49. The apparatus of claim 48 additionally comprising battery means suitable for powering said at least one electric motor.

50. The apparatus of claim 49 additionally comprising a pressure switch adapted to isolate said battery means when inner bore pressure nears atmospheric.

51. The apparatus of claim 49 additionally comprising means adapted to allow charging of said battery means.

52. The apparatus of claim 46 wherein said means for receiving an acoustic signal is adapted to be responsive to FSK signals of 310±20 Hz and 370±20 Hz.

53. The apparatus of claim 52 wherein said means for receiving an acoustic signal is adapted to be responsive to FSK signals of 316±4 Hz and 374±3 Hz.

* * * * *